United States Patent [19]

Lerner

[11] 4,024,031

[45] May 17, 1977

[54] SILVER PLATING

[75] Inventor: Lewis Brian Lerner, Linglestown, Pa.

[73] Assignee: AMP Incorporated, Harrisburg, Pa.

[22] Filed: Oct. 28, 1975

[21] Appl. No.: 625,975

[52] U.S. Cl. ..... 204/46 R
[51] Int. Cl.² ..... C25D 3/48
[58] Field of Search ..... 204/46 R

[56] References Cited

UNITED STATES PATENTS

| | | | |
|---|---|---|---|
| 744,170 | 11/1903 | Darlay | 204/46 R X |
| 2,435,525 | 2/1948 | Williams et al. | 204/46 R |
| 2,504,272 | 4/1950 | McCoy | 204/46 R |
| 3,174,918 | 3/1965 | Rinker et al. | 204/43 G |
| 3,427,232 | 2/1967 | Natwick | 204/32 |
| 3,691,032 | 9/1972 | Lubonsky et al. | 204/40 |

FOREIGN PATENTS OR APPLICATIONS

| | | | |
|---|---|---|---|
| 1,575,777 | 7/1969 | France | 204/46 R |

*Primary Examiner*—F.C. Edmundson

*Attorney, Agent, or Firm*—Russell J. Egan

[57] ABSTRACT

A plating process system has been disclosed which provides for a strike bath, a low current density plating bath or a high speed plating bath, the last for production of electroplating deposits with current densities in excess of 200 ASF; additionally, the strike bath may be used with the low current density plating bath as a combination, or as another combination, the strike bath is with the high speed, high current plating bath; the advantages are a compatible strike and plating bath; nonstaining deposits; buffered pH operations; neutral pH; no free cyanide in bath; elimination of drag-in problems from a strike bath vessel to plating bath vessel; reduced drag-out from this bath; higher current density capability and higher current density for lower total initial concentration in solution when compared to commercial baths presently available; the deposits are especially useful for high purity integrated circuits and provide an alternate system to gold for microelectronic circuits without any increased operation requirements.

23 Claims, No Drawings

SILVER PLATING

This invention relates to methods for electrodepositing silver from a strike, low current density, or high current density bath. These baths are compatible with each other. Further, a strike bath and either a low current density silver plating bath or a high speed silver plating bath such as a stripline plating bath in combination are part of the invention. More particularly, this invention provides for baths having a number of outstanding advantages and thus makes these baths suitable, based on the common components, with appropriate changes, as a strike bath, a low current density silver plating bath or a high current silver plating bath, or for a combination of a strike bath or with a high speed plating system in series without contamination of the down stream bath. The disclosed baths provide electrodeposits having outstanding properties for integrated circuit or microelectronic circuit plating.

Advantages of the present invention are the following: no free cyanide is retained in the bath but is tied up as AgCN or $KAg[CN]_2$; a high current density is applicable to these baths, especially the high speed bath which is achieved at lower total initial concentration of precious metal in the solution; inasmuch as these baths contain lower total metal concentration, there is less possibility of precious metal drag-out, hence, a reduction in costs for replenishment and rinse reclamation; an easy to monitor bath; simplified treatment, etc.

Still further, the present invention is directed to electrolytes for a strike bath, as such; electrolytes for a bath for low speed (or low current density) deposition of silver; and electrolytes for a high speed (or high current density) deposition of silver; or electrolytes for a strike bath in combination with a lower current density bath and/or further in combination with a high speed silver plating bath.

Additionally, the present invention provides for a solid, salt composition for use to make a strike bath or a modification thereof to make low speed or high speed plating baths.

BACKGROUND OF THE INVENTION

In depositing various combinations of strike and final deposit, it has often been proposed that different compositions for the strike bath and the final bath be used, e. g., a low current density, i. e., low speed bath or a high speed bath. As a result, the components from the strike bath are either dragged into the plating bath or precautions must be taken to insure that adequate rinsing or treatment has taken place. Consequently, additional process steps and more elaborate methods for assuring purity and non-staining of the final product are required and attendant increase in cost has often been sizable.

As most strike and silver plating baths are based on high cyanide content, for this reason, in general, a strike bath employed for silver electroplating in the prior art has been run at an alkaline pH. These baths contain silver on elemental basis at high concentrations.

Other baths are such as disclosed in U.S. Pat. No. 2,504,272 for deposition of silver from a pyrophosphate solution using silver pyrophosphate in combination with ammonium ions to form a soluble complex source of silver. Although a number of silver salts as a source of silver ions have been disclosed, the above-mentioned patent does not disclose the presently claimed combination for either strike, low speed or high speed. While a prestrike or pretreatment plating has been disclosed, the silver deposit is from a bath of relatively low silver concentration and using ammonium ions to complex silver as a source of silver ions.

Further, in U.S. Pat. No. 3,427,232 a process is described for electroplating silver, but in this prior art the use of silver cyanide bath is deprecated as not being useful for plating, especially on the particular magnesium substrate. Inasmuch as the disclosed combination is different and suggests not to combine a silver cyanide bath with the disclosed bath, the method disclosed in this patent is inapplicable with respect to the prestrike, or final deposit combination disclosed herein.

In U.S. Pat. No. 2,435,525, a disclosure of a prestrike has been found which shows a copper cyanide bath used for depositing copper and thereafter the substrate is rinsed and dipped in a cyanide solution free of copper and silver ions. A silver strike is then applied on the copper strike, employing a bath of low current density after which the work piece to be plated is transferred to a silver plating bath operated at a higher current density. The strike bath as well as the plating bath, however, have a different combination of elements and these provide for a very high pH such as between 12.6 and 13.4.

Other strike and final deposit combinations have been shown in U.S. Pat. Nos. 2,493,092 and 3,329,522. However, the deposits which have been obtained are based on different metals, and these baths are not applicable with respect to silver plating.

Another cyanide free succinic acid (hence an organic) bath has been disclosed in vague terms in *Chemical Engineering*, Sept. 15, 1975, on page 68.

In view of the above, it is readily evident that a bath which has been used in the prior art for final plating seldom, if ever, corresponds to a strike bath or vice-versa; the combination of the elements in each bath is different as well as the components used therewith. Moreover, a bath having as low a silver concentration as for the present baths which is essentially at neutral pH and operates substantially without free cyanides and consists essentially of only inorganic constituents has not been described in the prior art according to my knowledge.

DESCRIPTION OF THE INVENTION AND EMBODIMENT THEREOF

Accordingly, it has been found: a strike bath; a low speed bath; and a high speed bath which are useful in a method for plating a precious metal such as silver on copper, copper alloys such as brasses, etc. Thus, a strike, a low speed, or a high speed silver plating methods have been provided to achieve heretofore unknown advantages such as recited previously for obtaining, by electrolytic deposition, superior deposits of silver.

Additionally, a strike bath either alone or in combination with a low speed bath or a high speed bath has been discovered which provides the same and additional advantages and benefits such that the drag-in and contamination from the strike bath does not affect the other bath.

Similarly, a bath composition for a strike and a high speed plating bath provide for a number of advantages resulting from the combination.

The obtained deposits from the strike bath allow for the preparation of heavier metal deposits of outstanding physical properties with good adhesion to the substrate and a deposit (such as by the Scotch tape, i. e., bonded and incapable of stripping by the tape; as well as no exfoliation at 180° bend).

By definition, the baths herein are characterized as follows:

1. Strike — Low concentration bath 0.1 to 0.5 oz./metal/gal. of bath solution.

2. Low Speed — 1 – 2.0 oz./metal/gal. of bath solution at plating rate of 25 to 40 ASF (amperes per square foot) generally up to 30 ASF.

3. High Speed — 2.5 – 5 oz./metal/gal. of bath solution, at plating rates of 5 to 200 ASF, and vigorous agitation up to 400 ASF in a stripline plating apparatus.

As it is evident from the above, the amount of precious metal in the bath is low by comparison to cyanide baths which for corresponding baths vary from 5 oz. to 12 oz. of metal per gallon of bath solution. Consequently, there is less possibility of precious metal drag-out. Thus, a corresponding reduction in costs for operating the bath is associated with low drag-out replenishment. Moreover, for the present bath no free cyanide is retained in the bath either at make up or it is tied up as AgCN or $KAg[CN]_2$.

In addition, it has been found that the following advantages are also manifested. The effluent from the bath can be easily handled by waste treatment systems presently employed for conventional bath effluents, such as high cyanide baths or even non-cyanide baths. For example, the waste treatment procedure requires only that a waste solution is reduced in pH to 3.5 to 4.0 with $HPO_3$ to precipitate silver monocyanide (AgCN). The precipitate can be worked up and reused to make up a new silver plating bath by simply adding potassium cyanide (KCN) to silver monocyanide in solution. Hence, no additional steps of reclaiming the precious metal solution from the waste solution is needed.

The deposits are further substantially nonstaining (no free cyanide) which eases the rinsing requirements. The nonstaining characteristics of the deposit are not only applicable with respect to the strike bath but also final deposit.

A buffered neutral pH operation provides a non-corrosive environment because the baths are at pH 6.8 – 7.2 for all three baths to which the parts to be electroplated are subjected. Inasmuch as the strike bath and plating bath compositions are compatible, the contaminants do not occur as a result of drag-in problems or surface adhesion.

With respect to the high speed operations now becoming increasingly necessary to obtain high plating rates on a continuously moving substrate strip, the present baths are especially useful because of the tolerance to high current densities. These high current densities are achieved at lower total, initial concentration of the precious metal in solution.

Additional benefits which have been observed include such as simplified make up of the bath combination which is not only easy to control but also to analyze; organic additives are merely optional thus eliminating the decomposition of these additives at high operating temperatures such as in high stripline plating; the present bath provides alternate deposits to gold for microelectronic applications without any increased operational requirements; because of high purity deposits, the integrated circuit purity requirement can be met; the deposits are highly resistant to tarnish after prolonged time of storage at ambient conditions, the present bath composition not only can be plated by means of the high speed line, but pulse plating and selective plating of the bath composition produces excellent deposits as well. Still further, exposure to $H_2S$ at equivalent levels on present deposits and prior art deposits provides improvements which are greater by a factor of 2 to 3 at least.

With respect to the above described strike bath, the following table lists the combination of elements with an appropriate range as well as the optimum concentration of elements. The operating conditions have been set forth as well as the resulting deposit.

TABLE I

| STRIKE BATH | Grams/liter Range | Grams/liter Optimum | Oz./gal. Optimum |
|---|---|---|---|
| *Potassium Phosphate Monobasic (Anhydrous basis) $KH_2PO_4$ (a) | 12.5–25 | 15 | 2.0 |
| *Potassium Phosphate Dibasic (Anhydrous basis) $K_2HPO_4$ (b) ratio a to b about 1:2 or, in combination, to provide operational pH at make up or start up, to be equivalent, within the range specified, when using: | 25–50 | 35 | 4.7 |
| *Potassium Phosphate Dibasic (Hydrate) $K_2HPO_4 . 3H_2O$ (on trihydrous basis) | 32.5–65 | 45 | 6.0 |
| Silver as $KAg[CN]_2$ | 1.9–3.8 | 2.5 | 0.33 |

*Instead of potassium, less desired salts are the sodium and ammonium species of the above salts.

System operates at 6 to 8 volts, room temperature, no agitation for 5 to 20 seconds. Resulting deposit is matte gray.

TABLE II

| LOW SPEED BATH (Used also in Advantageous Combination with Strike Bath) | Grams/liter Range | Grams/liter Optimum | Oz./gal. Optimum |
|---|---|---|---|
| *Potassium Phosphate Monobasic (Anhydrous) $KH_2PO_4$ | 25 – 50 | 35 | 4.7 |
| *Potassium Phosphate Dibasic (Anhydrous) $K_2HPO_4$ or (see note in Table I) | 50 – 100 | 70 | 9.3 |
| *Potassium Phosphate Dibasic (Hydrate) $K_2HPO_4.3H_2O$ (a + b): c in a ratio of 2.5 to 1 | 65 – 130 | 90 | 11.3 |
| Silver as $KAg[CN]_2$ | 7.5 – 15 | 11.25 | 1.5 |

| Operating Conditions | Range | Optimum |
|---|---|---|
| Temperature | 120 – 180° F | 140° F |
| pH | 6.8 – 7.2 | 7.0 |
| Anodes | — | Platinum |
| Agitation | — | Vigorous |
| Anode : Cathode Ratio | Minimum 1:1 to 40 inch² anode/ 1 inch² cathode | — |
| Current Density | 5 – 30 ASF | 15 ASF |

*see note in Table I.

TABLE III

| HIGH SPEED BATH | Grams/liter Range | Grams/liter Optimum | Oz./gal. |
|---|---|---|---|
| *Potassium Phosphate Monobasic (Anhydrous) $KH_2PO_4$ | 35 – 75 | 50 | 6.75 |
| *Potassium Phosphate Dibasic (Anhydrous) $K_2HPO_4$ or (see note in Table I) | 70 – 150 | 100 | 13.35 |
| *Potassium Phosphate Dibasic (Hydrate) $K_2HPO_4.3H_2O$ | 90 – 195 | 130 | 17.35 |
| Silver as $KAg[CN]_2$ | 15 – 38 | 35 | 2.0 – 5.0 |

| Operating Conditions | Range | Optimum |
|---|---|---|

TABLE III-continued

| | HIGH SPEED BATH | |
|---|---|---|
| Temperature | 140° – 190° F | 160° F |
| Specific Gravity (25° C) | — | Min. 17.0° Be |
| pH | 6.8 – 7.2 | 7.0 |
| Anodes | — | Platinum |
| Agitation | — | Vigorous |
| Current Density | 50 – 200+ASF (50 – 400+ASF provided at high ASF range solution is properly agitated.) | — |

*see note in Table I.

Continuous filtration may be employed if desired for the bath described in Tables II and III. A grain refiner of ethylenediaminetetra-acetic acid (EDTA) can be used with the baths described in Tables II and III, although the bath operates most equally well without this additive. Quantities of EDTA of 5 to 12 grams/liter with an optimum of 6 grams/liter are suggested.

If insolubles form in the system, these may represent silver monocyanide (AgCn) which redissolves immediately with the addition of very small amounts of potassium cyanide (KCN), e. g., 0.25 – 1.0 grams/liter.

As it is evident from the above, the strike bath may be used in combination with the low speed system disclosed in Table II as one of the combinations; the components in each of the baths are substantially the same, but the proportions of each have been changed. The cyanide content as it is evident from the tables above is low and the operating conditions thus provide for a fairly safe system at the neutral pH.

With respect to the high speed bath, although the current densities may be up to 200 ASF and higher, e.g., up to 300 ASF and higher e.g. up to 400 ASF, the deposits are prevented from burning by the combination of elements in the bath, i. e., no organics and the methods employed, such as when during stripline plating proper agitation is used. The thus obtained deposits are of excellent characteristics as previously mentioned. The organic free bath results of deposits which give few, if any problems when bonding these deposits such as by ultrasonic bonding.

The obtained deposits are of low porosity, ductile and soft (in comparison to prior art cyanide deposits) e.g., Knoop values (25 grams load) are 80 to 100 Knoop units.

The above disclosed baths are also easy to monitor for either the precious metal or electrolyte, i.e., —$PO_4$ determination requires only a single procedure, additions are made relative to a specific salt concentration of 1 part $KH_2PO_4$ to 2 parts $K_2HPO_4$ to maintain a given pH. For silver, the bath solution is analyzed by merely dropping pH of aliquot sample to 3.5 to 4.0 with $HPO_3$, by weighing the resulting precipitate which is AgCN and calculating for metal.

The combination of elements given above indicate that no buffering agents are added, pH is achieved as make up components are added, no additional acid or alkali has to be added.

Inasmuch as the concentration of precious metal in the bath is low, the metal drag out from a bath solution in a rinse bath is also lower; as a result, a less frequent treatment to reclaim the metal values from the rinse solution is also needed.

After recovery of silver, a waste solution is substantially $PO_4$ ion (as either $KH_2PO_4$ or $K_2HPO_4$). This solution can be bulk treated as a general chemical waste effluent.

The following examples are illustrative of the process and are being submitted merely as illustrations and not to limit the broader concept disclosed herein.

Example 1

The following strike bath was used on copper base alloys:

| | |
|---|---|
| Potassium Phosphate Monobasic (Anhydrous basis) $KH_2PO_4$, and | 15 gr./liter |
| Potassium Phosphate Dibasic (Anhydrous basis) $K_2HPO_4$ | 35 gr./liter |
| or | |
| Potassium Phosphate Dibasic (Hydrate) $K_2HPO_4.2H_2O$ (on trihydrous basis) | 45 gr./liter |
| Silver as $KAg[CN]_2$ | 2.5 gr./liter |
| For operating conditions see Table I. | |

Example 2

The following low speed bath was used on copper base alloys:

| | |
|---|---|
| Potassium Phosphate Monobasic (Anhydrous) $KH_2PO_4$ | 35 gr./liter |
| Potassium Phosphate Dibasic (Anhydrous) $K_2HPO_4$ | 70 gr./liter |
| or | |
| Potassium Phosphate Dibasic (Hydrate) $K_2HPO_4.3H_2O$ | 85 gr./liter |
| Silver as $KAgCN_2$ | 11.25 gr./liter. |
| Operating Conditions | |
| Temperature | 140° F |
| pH | 7.0 |
| Anodes | Platinum |
| Agitation | Vigorous |
| Anode : Cathode Ratio | 1:1 (1 inch² anode to 1 inch² cathode) |
| Current density | 5 – 30 ASF |

Example 3

The following high speed bath was used on copper base alloys:

| | |
|---|---|
| Potassium Phosphate Monobasic (Anhydrous) $KH_2PO_4$ | 50 gr./liter |
| Potassium Phosphate Dibasic (Anhydrous) $K_2HPO_4$ | 100 gr./liter |
| or | |
| Potassium Phosphate Dibasic (Hydrate) $K_2HPO_4.3H_2O$ | 130 gr./liter |
| Silver as $KAgCN_2$ | 25 gr./liter |
| Operating Conditions | |
| Temperature | 160° F |
| Specific Gravity (25° C) | Min. 17.0° Be |
| pH | 7.0 |
| Anodes | Platinum |
| Agitation | Vigorous |
| Current Density | Up to 200 ASF |

According to Example 3 in the stripline process, AMP CHAMP™ connectors, such as used in telephone 25 pair wire connections, were plated. Similarly, by this process, lead frames were plated.

In accordance with the process in Example 2, plating at low speed, AMP-LEAD™ a socket type terminal pin contacts used on P.C. boards were plated, the obtained electrodeposit had good properties.

From the above described examples and embodiments, it is evident that a novel plating system, with subcombinations thereof, has been discovered which, although made up from readily available components, has provided long sought advantages, such as listed above including the lower precious metal concentration. As a result, a system which is less expensive to make up, as well as to run, than commercially available high cyanide systems is now available, especially suitable also for high rates of deposition because of high current density capability and higher current density useable for lower total initial metal concentration in solution.

What is claimed is:

1. A process for depositing on a workpiece a silver electrodeposit from an electrolyzed silver plating bath comprising an aqueous solution of

| | |
|---|---|
| Potassium Phosphate Monobasic (Anhydrous) $KH_2PO_4$, and | (a) 25 – 50 grams/liter |
| Potassium Phosphate Dibasic (Anhydrous) $K_2HPO_4$ | (b) 50 – 100 grams/liter |
| or | |
| Potassium Phosphate Dibasic (Hydrate) $K_2HPO_4 . 3H_2O$ | (c) 65 – 130 grams/liter |

the ratio of (a) to (b) being about 1:2 or if the hydrate (c) is used, the amount equivalent on an anhydrous basis to (b), in the same ratio of (a) to (b)

Silver as $KAg[CN]_2$: 7.5 – 15 grams/liter said bath being at a temperature from 120° to 180° F at a pH of 6.8 to 7.2 and a current density of 5 to 30 ASF depositing on said workpiece said silver electrodeposit and recovering said workpiece.

2. The process as defined in claim 1 wherein potassium cyanide is added when insoluble silver monocyanide is formed in said bath, said potassium cyanide being added in an amount from 0.25 to 1.0 grams per liter to said bath solution.

3. A process for the depositing on a workpiece a silver deposit from an electrolyzed silver plating bath comprising electrodepositing on said workpiece silver from an aqueous solution of

| | |
|---|---|
| Potassium Phosphate Monobasic (Anhydrous) $KH_2PO_4$, and | (a) 35 – 75 grams/liter |
| Potassium Phosphate Dibasic (Anhydrous) $K_2HPO_4$ | (b) 70 – 150 grams/liter |
| or | |
| Potassium Phosphate Dibasic (Hydrate) $K_2HPO_4.3H_2O$ | (c) 90 – 195 grams/liter |

the ratio of (a) to (b) being about 1:2 or if the hydrate (c) is used, the amount equivalent on an anhydrous basis to (b), in the same ratio of (a) to (b)

Silver as $KAg[CN]_2$: 15 – 38 grams/liter said bath being at a temperature of 140° to 190° F, at a pH of 6.8 to 7.2 said electrodepositing being at 50 to 400 ASF with vigorous agitation, and recovering said workpiece with an electrodeposit of silver thereon.

4. The process as described in claim 3 wherein as a grain refiner, ethylenediaminetetra-acetic acid is added in an amount from 5 to 12 grams per liter to the bath composition identified as B.

5. The process as described in claim 3 wherein as a grain refiner, ethylenediaminetetra-acetic acid is added in an amount from 5 to 12 grams per liter of said bath solution to the bath composition identified as B.

6. The process as defined in claim 3 wherein potassium cyanide is added when insoluble silver monocyanide is formed in said bath, said potassium cyanide being added in an amount from 0.25 to 1.0 grams per liter to said bath solution.

7. A process for depositing on a workpiece a strike of silver comprising; electrolyzing an aqueous solution of:

| | |
|---|---|
| Potassium Phosphate Monobasic (Anhydrous) $KH_2PO_4$, and | (a) 12.5 – 25 grams/liter |
| Potassium Phosphate Dibasic (Anhydrous) $K_2HPO_4$ | (b) 25 – 50 grams/liter |
| or | |
| Potassium Phosphate Dibasic (Hydrate) $K_2HPO_4.3H_2O$ | (c) 32.5 – 65 grams/liter |

the ratio of (a) to (b) being about 1:2 or if the hydrate (c) is used, the amount equivalent on an anhydrous basis to (b), in the same ratio of (a) to (b)

Silver as $KAg[CN]_2$ 1.9 – 3.8 grams/liter said bath being at a room temperature; and depositing on a cathodic substrate a strike for 5 to 20 seconds.

8. The process as defined in claim 7 wherein potassium cyanide is added when insoluble silver monocyanide is formed in said bath, said potassium cyanide being added in an amount from 0.25 to 1.0 grams per liter to said bath solution.

9. A process for depositing on a workpiece a strike of silver in combination with a low speed silver deposition process, the strike subprocess comprising electrolyzing an aqueous solution comprising of

| | | |
|---|---|---|
| A) Potassium Phosphate Monobasic (Anhydrous) $KH_2PO_4$, and | (a) | 12.5 – 25 grams /liter |
| Potassium Phosphate Dibasic (Anhydrous) $K_2HPO_4$ | (b) | 25 – 50 grams /liter |
| or | | |
| Potassium Phosphate Dibasic (Hydrate) $K_2HPO_4.3H_2O$ | (c) | 32.5 – 65 grams /liter |

the ratio of (a) to (b) being about 1:2 or if the hydrate (c) is used, the amount equivalent on an anhydrous basis to (b), in the same ratio of (a) to (b)

Silver as $KAg[CN]_2$: 1.9 – 3.8 grams/liter said bath being at a room temperature; depositing on a cathodic substrate a strike for 5 to 20 seconds and continuing said deposition on the said strike bath deposit by introducing said workpiece in an electrolyzed silver plating bath comprising an aqueous solution of

| | | |
|---|---|---|
| B) Potassium Phosphate Monobasic (Anhydrous) $KH_2PO_4$, and | (a) | 35 grams/liter |
| Potassium Phosphate Dibasic (Anhydrous) $K_2HPO_4$ | (b) | 70 grams/liter |
| or, in lieu of anhydrous dibasic phosphate | | |
| Potassium Phosphate Dibasic $K_2HPO_4.3H_2O$ | (c) | 90 grams/liter |
| Silver as $KAg[CN]_2$ | | 11.25 grams/liter |

said bath being at a temperature from 120° to 180° F at a pH of 6.8 to 7.2 and a current density of 5 to 30 ASF.

10. A process for depositing a strike of silver on a workpiece in combination with a high speed silver deposition process, said strike deposition subprocess comprising electrolyzing a solution comprising of

| | | |
|---|---|---|
| A) Potassium Phosphate Monobasic (Anhydrous) $KH_2PO_4$, and | (a) | 12.5 – 25 grams /liter |
| Potassium Phosphate Dibasic (Anhydrous) $K_2HPO_4$ | (b) | 25 – 50 grams /liter |
| or | | |

-continued

| | | |
|---|---|---|
| Potassium Phosphate Dibasic (Hydrate) $K_2HPO_4.2H_2O$ | (c) | 32.5 – 65 grams /liter |

the ratio of (a) to (b) being about 1:2 or if the hydrate (c) is used, the amount equivalent on an anhydrous basis to (b), in the same ratio of (a) to (b)

Silver as $KAg[CN]_2$: 1.9 – 3.8 grams/liter said bath being at a room temperature and the deposition of a strike being for 5 to 20 seconds, and combining the deposition in said strike bath with a deposition in a bath electrolyzed to deposit a silver deposit from an aqueous solution comprising a composition of

| | | |
|---|---|---|
| B) Potassium Phosphate Monobasic (Anhydrous) $KH_2PO_4$, and | (a) | 50 grams/liter |
| Potassium Phosphate Dibasic (Anhydrous) $K_2HPO_4$ | (b) | 100 grams/liter |
| or, in lieu of anhydrous dibasic phosphate | | |
| Potassium Phosphate Dibasic (Hydrate) $K_2HPO_4.3H_2O$ | (c) | 130 grams/liter |
| Silver as $KAg[CN]_2$ | | 19 – 38 grams/liter |

said bath being operated at a temperature from 140° to 190° F at pH 6.8 to 7.2 and at a current density from 50 to 400 ASF with vigorous agitation and recovering said workpiece with an electrodeposit of silver thereon.

11. A strike bath for depositing silver, said strike bath comprising an aqueous solution of

| | | |
|---|---|---|
| Potassium Phosphate Monobasic (Anhydrous) $KH_2PO_4$, and | (a) | 12.2 – 25 grams/liter |
| Potassium Phosphate Dibasic (Anhydrous) $K_2HPO_4$ | (b) | 35 – 50 grams/liter |
| or | | |
| Potassium Phosphate Dibasic (Hydrate) $K_2HPO_4.3H_2O$ | (c) | 32.5 – 65 grams/liter |

the ratio of (a) to (b) being about 1:2 or if the hydrate (c) is used, the amount equivalent on an anhydrous basis to (b), in the same ratio of (a) to (b)

Silver as $KAg[CN]_2$: 1.9 – 3.8 grams/liter.

12. A strike bath for depositing silver as defined in claim 11, said strike bath comprising an aqueous solution of

| | | |
|---|---|---|
| Potassium Phosphate Monobasic (Anhydrous) $KH_2PO_4$, and | (a) | 15 grams/liter |
| Potassium Phosphate Dibasic (Anhydrous) $K_2HPO_4$ | (b) | 35 grams/liter |
| or | | |
| Potassium Phosphate Dibasic (Hydrate) $K_2HPO_4.3H_2O$ | (c) | 45 grams/liter |

the ratio of (a) to (b) being about 1:2 or if the hydrate (c) is used, the amount equivalent on an anhydrous basis to (b), in the same ratio of (a)

Silver as $KAg[CN]_2$: 2.5 grams/liter.

13. A high speed bath for depositing silver, said bath comprising of an aqueous solution of

| | | |
|---|---|---|
| Potassium Phosphate Monobasic (Anhydrous) $KH_2PO_4$, and | (a) | 35 – 75 grams/liter |
| Potassium Phosphate Dibasic (Anhydrous) $K_2HPO_4$ | (b) | 70 – 150 grams/liter |
| or | | |
| Potassium Phosphate Dibasic (Hydrate) $K_2HPO_4.3H_2O$ | (c) | 90 – 195 grams/liter |

the ratio of (a) to (b) being about 1:2 or if the hydrate (c) is used, the amount equivalent on an anhydrous basis to (b), in the same ratio of (a) to (b)

Silver as $KAg[CN]_2$: 15 – 38 grams/liter.

14. The bath as defined in claim 13 wherein ethylenediaminetetra-acetic acid is added in a quantity of 5 to 12 grams per liter of said bath solution.

15. The bath as defined in claim 13 wherein ethylenediaminetetra-acetic acid is added in a quantity of 6 grams per liter of said bath solution.

16. The bath as defined in claim 13 wherein potassium cyanide is added in an amount from 0.25 to 1.0 grams per liter for dissolving insoluble forms of silver monocyanide.

17. A high speed bath for depositing silver, said bath comprising of an aqueous solution of

| | | |
|---|---|---|
| Potassium Phosphate Monobasic (Anhydrous) $KH_2PO_4$, and | (a) | 50 grams/liter |
| Potassium Phosphate Dibasic (Anhydrous) $K_2HPO_4$ | (b) | 100 grams/liter |

or, in lieu of anhydrous dibasic phosphate

| | | |
|---|---|---|
| Potassium Phosphate Dibasic (Hydrate) $K_2HPO_4.3H_2O$ | (c) | 130 grams/liter |
| Silver as $KAg[CN]_2$ | | 15 – 38 grams/liter. |

18. A low speed bath for depositing silver, said bath comprising an aqueous solution of

| | | |
|---|---|---|
| Potassium Phosphate Monobasic (Anhydrous) $KH_2PO_4$, and | (a) | 25 – 50 grams/liter |
| Potassium Phosphate Dibasic (Anhydrous) $K_2HPO_4$ | (b) | 50 – 100 grams/liter |
| or | | |
| Potassium Phosphate Dibasic (Hydrate) $K_2HPO_4.3H_2O$ | (c) | 65 – 130 grams/liter |

the ratio of (a) to (b) being about 1:2 or if the hydrate (c) is used, the amount equivalent on an anhydrous basis to (b), in the same ratio of (a) to (b)

Silver as $KAg[CN]_2$: 7.5 – 15 grams/liter.

19. The bath as defined in claim 18 wherein potassium cyanide is added in an amount from 0.25 to 1.0 grams per liter for dissolving insoluble forms of silver monocyanide.

20. A solid storage stable salt composition for use in the preparation of a bath comprising essentially of potassium phosphate monobasic, potassium phosphate dibasic, or potassium phosphate dibasic trihydrate, and silver dicyanide.

21. The composition as defined in claim 20 and additionally 5 to 12 grams of ethylenediaminetetra-acetic acid.

22. A low speed bath for depositing silver, said bath comprising an aqueous solution of

| | | |
|---|---|---|
| Potassium Phosphate Monobasic (Anhydrous) $KH_2PO_4$, and | (a) | 35 grams/liter |
| Potassium Phosphate Dibasic (Anhydrous) $K_2HPO_4$ or, in lieu of anhydrous dibasic phosphate | (b) | 70 grams/liter |
| Potassium Phosphate Dibasic (Hydrate) $K_2HPO_4.3H_2O$ | (c) | 90 grams/liter |
| Silver as $KAg[CN]_2$ | | 11.25 grams/liter. |

23. A solid salt composition, as a storage stable composition, useful for dilution and preparation of a silver plate bath, said composition consisting essentially of potassium phosphate monobasic, potassium phosphate dibasic, or potassium phosphate dibasic, in combination with silver, as potassium silver dicyanide, in the following proportions on basis of a unit, in liters, of bath solution

| | | |
|---|---|---|
| Potassium Phosphate Monobasic (Anhydrous) $KH_2PO_4$, and | (a) | 50 grams/liter |
| Potassium Phosphate Dibasic (Anhydrous) $K_2HPO_4$ or, in lieu of anhydrous dibasic phosphate | (b) | 100 grams/liter |
| Potassium Phosphate Dibasic (Hydrate) $K_2HPO_4.3H_2O$ | (c) | 130 grams/liter |
| Silver as $KAg[CN]_2$ | | 15 - 38 grams/liter. |

* * * * *